US008991169B2

(12) United States Patent
Zoppi

(10) Patent No.: US 8,991,169 B2
(45) Date of Patent: Mar. 31, 2015

(54) METHOD FOR ADAPTING STIFFNESS IN A VARIABLE STIFFNESS ACTUATOR

(76) Inventor: Matteo Zoppi, Genoa (IT)

( * ) Notice: Subject to any disclaimer, the term of this patent is extended or adjusted under 35 U.S.C. 154(b) by 447 days.

(21) Appl. No.: 13/592,658

(22) Filed: Aug. 23, 2012

(65) Prior Publication Data

US 2013/0047596 A1 Feb. 28, 2013

(30) Foreign Application Priority Data

Aug. 26, 2011 (IT) ..... GE2011A0096

(51) Int. Cl.
*F15B 11/06* (2006.01)
*F15B 21/06* (2006.01)

(52) U.S. Cl.
CPC ..... *F15B 11/06* (2013.01); *F15B 21/06* (2013.01)
USPC ..... 60/469; 60/415

(58) Field of Classification Search
None
See application file for complete search history.

(56) References Cited

U.S. PATENT DOCUMENTS

| | | | | |
|---|---|---|---|---|
| 3,406,850 | A | 10/1968 | Hancox | |
| 3,855,791 | A * | 12/1974 | Quinto | 60/476 |
| 4,910,529 | A | 3/1990 | Regnault | |
| 4,998,116 | A | 3/1991 | Regnault | |
| 5,018,606 | A * | 5/1991 | Carlson | 188/267.1 |
| 5,682,923 | A * | 11/1997 | Goloff et al. | 138/30 |
| 6,378,671 | B1 * | 4/2002 | Carlson | 188/267.2 |
| 7,874,407 | B2 * | 1/2011 | Wereley et al. | 188/267.2 |
| 8,413,436 | B2 * | 4/2013 | Li et al. | 60/418 |
| 8,567,185 | B1 * | 10/2013 | Theobald et al. | 60/413 |
| 2010/0326062 | A1 | 12/2010 | Fong | |

* cited by examiner

*Primary Examiner* — Thomas E Lazo
(74) *Attorney, Agent, or Firm* — Themis Law

(57) ABSTRACT

A method for adapting stiffness in a variable stiffness actuator includes a member configured to transmit motion that is connected to a fluidic circuit, into which a control fluid circulates. The fluidic circuit includes a supply and distribution unit of the control fluid having a reservoir of the control fluid and a pumping unit. The supply and distribution unit includes two distribution lines of the control fluid, which are fluidly connected to the actuator such that an increase and/or decrease in the pressure of the control fluid activates the member that transmits motion. The stiffness of the actuator is adapted by adapting the pressure of the control fluid into the two distribution lines. The present invention includes also a variable stiffness actuator utilizing the above method for adapting stiffness.

17 Claims, 3 Drawing Sheets

METHOD FOR ADAPTING STIFFNESS IN A VARIABLE STIFFNESS ACTUATOR

FIELD OF THE INVENTION

The present invention comprises a method for adapting stiffness in a variable stiffness actuator. One such variable stiffness actuator includes a member for the transmission of motion and is connected to a fluidic circuit into which a control fluid circulates.

The fluidic circuit presents a supply and distribution unit of the control fluid, which includes a reservoir of the control fluid and pumping means, the supply and distribution unit having two distribution lines of the fluid, the distribution lines being connected, by means of hydraulic pipes, to the actuator in such a way that an increase and/or decrease of the pressure of the control fluid activates the member for the transmission of motion.

The present invention includes also a variable stiffness actuator as described above for the application of the method that is a subject of the present invention.

BACKGROUND OF THE INVENTION

Actuators with variable stiffness and methods for controlling of their stiffness are of industrial interest and have an increasing potential of industrial applications.

In particular, such actuators may be utilized in industrial robots for motion and control of the actuated links of the robot.

The problem of adaptation and control of the stiffness and not only of position of the links of the robot during its motion arises when a robot is expected to perform motion tasks involving or in the presence of humans, or when collisions with the environment are possible.

In these cases, a control of the motion should provide a desired accuracy of velocity and position accuracy, which may be different in different stages of motion of the robot, while, at the same time, minimizing the risk that the robot and the environment are damaged and humans in the working envelope of the robot are injured due to collisions.

Several solutions have been the studied to decouple part of the inertia of the links of a robot from the end-effector link in order to reduce the kinetic energy transferred during a collision.

One of the first solutions that was attempted was to cover the links of the robot with soft panels, such as pads, in combination with collision sensors, in such a way that, when a collision happens, the soft panels deform giving time to the sensors to detect the collision and to the control system to react to the collision, for example by stopping the motors or inverting their directions of rotation.

Another solution that was considered was to mount passive compliant elastic elements between each motor and the link it drives. These elastic elements limit mechanically the inertial torque that each motor can transmit between the preceding and following link in the event of collision.

With the use of passive compliant elements in series with the motors, it is not possible to adapt the stiffness to the motion task requirements and, consequently, either the robot is in a precise position but is stiff or has a coarser accuracy of position but is better compliant.

Like in human and in animal beings, what is researched is the adaptation of the motion accuracy of the robot and of its stiffness according to the motion to be accomplished and the task of the robot.

If, for example, the task consists of moving an object from location A to location B, geometric accuracy during the trajectory from A to B can be coarse since the requirement is only to move the object from A to B, independently of the velocity with which the task is performed.

In a human, such a repositioning operation is performed with the muscles of the arm i a relatively relaxed state, just supporting the load with no tensions in antagonistic muscles to stiffen the arm. This way, the arm operates at low stiffness.

Differently, if a precise motion must be performed, such as during the assembly of two small parts or the threading a needle, high accuracy and low velocity are generally required.

To perform such movements, a human being increases the stiffness of all muscles involved in the motion, agonistic and antagonistic, in order to increase position accuracy at every point of the trajectory.

It may happen that the external force applied by the arm to the environment during the performance of the task is the same in the two cases of coarse and accurate motion tasks, but, in the case of an accurate motion task, the absolute values of the forces in the arm are higher although the difference is the same at same external force.

The above considerations have suggested the development and use, in robots, of systems for an active adaptation of the stiffness of the joints to the requirements of motion and task, such as variable stiffness actuators.

Several variable stiffness actuators are discussed in the prior art. Such actuators use mechanical springs and other elastic elements together with motors that command the positions of the links of the robot.

Each link of the robot mounts a motor that commands the position of the link, and the stiffness is adapted on the base of sensory feedbacks.

The effectiveness of this approach is limited by the limited bandwidth of the system, which is due to the delay of response of the sensor and the time of detection, transmission and use of the information before the motor is consequently operated.

Today, three families of architectures of variable stiffness actuator have been introduced: Serial-type Dual Actuator (SDA), Parallel-type Dual Actuator (PDA), and Hybrid-type Dual Actuator (HDA).

The SDA use, for each axis, a main actuator used to command the position and velocity of the driven link, and a secondary actuator responsible for the variation of the stiffness.

The PDA use a principle similar to the one in a human arm, with an agonistic and an antagonistic muscle. Two actuators operate in parallel the driven link, and a nonlinear elastic element is mounted in series to each actuator rendering independent the control of position and stiffness.

The HDA use two actuators arranged in any combination different from the serial one used in the SDA and the purely parallel one used in the PDA. For example, the two actuators may apply to the driven link a variable force at a variable distance from the axis of rotation with a nonlinear elastic element present at the point of application of the force.

All these types of actuators involve mechanical and electronic components which are subject to wear and failure that compromise the functioning of the system, for example, elastic elements like mechanical springs.

Moreover, due to the complexity of the design, these actuators can hardly be used at a micro scale, in applications that require small dimensions.

Therefore, there is an unsatisfied practical need for a device that overcomes the described above limitations and disadvantages, which are typical of the variable stiffness actuators in use. Such device should use simple and cost-effective solutions, and should be easy to integrate in robots whose tasks comprise interactions with humans.

SUMMARY OF THE INVENTION

The present invention meets the above described needs by means of a method that includes the use of an actuator, for which stiffness is adapted of the stiffness by adapting the pressure of the control fluid in two distribution lines.

Moreover, the control fluid is made of two fluids, a first fluid and a second fluid, separated from each other and in proportions having a predefined ratio.

Since the force applied by the actuator to the environment depends on the pressure difference between the two distribution lines, it is possible to adapt this pressure difference to obtain any desired force of the actuator.

Preferably, a method according to the present invention uses as a first fluid a compressible fluid and as a second fluid an incompressible fluid, in such a way that the adaptation of the stiffness of the actuator is obtained through the adaptation of the pressure of the two fluids, which are nonmixable.

Preferably, the compressible fluid is used as a nonlinear elastic element to adapt the stiffness of the actuator, while the incompressible fluid is used to change the compression of the compressible fluid.

The pressures of both fluids are used to operate the motion of the actuator.

Alternatively, the first fluid and the second fluid are both gaseous and the adaptation of the stiffness of the actuator is achieved by means of the variation of the pressures of the two gases.

In a preferred embodiment, a method according to the invention uses transfers of fluid in/out of the distribution lines in order to generate differences of pressure of the fluid in the distribution lines such that the difference of pressure is constant, although the absolute values of the pressures in the distribution lines are different.

The difference between the fluid pressures in the two distribution lines can therefore be maintained constant, obtaining any desired value of the resulting force applied by the actuator to the environment and at the same time adapting the accuracy of motion of the actuator to any task requirement. Similarly to the operation of the human muscle-skeletal system, when the absolute values of the pressures inside the two distribution lines are increased by a same quantity, the resulting force remains constant but the stiffness of the system increases and consequently the position accuracy of the motion.

Vice versa, when the absolute values of the pressures inside the two distribution lines are reduced by a same quantity, the resulting force remains constant but the stiffness of the system is reduced and consequently the accuracy of the motion.

One embodiment of a method according to the present invention includes a step of controlling the pressures by means of a sensing element.

It is possible to use only one sensing element transducing the pressure difference between the two distribution line, or two sensing elements, one for each distribution line.

A relevant aspect of a method according to the present invention is that pressure can be controlled in real-time, so making it possible to control the motion of the device driven by the actuator, for example the link of a robot.

Such real-time control may be performed either automatically, using the information provided by the pressure sensors, or manually.

The present invention includes also a variable stiffness actuator for the application of the method discussed.

The use of an actuator in combination with a hydraulic circuit for producing a variable stiffness actuator is new in the field of robotics, where, at the moment, electromechanical actuators are considered as variable stiffness actuators.

Adaptation of the stiffness inside the actuator is achieved by use of a control fluid made of two fluids that include a first fluid and a second fluid separated from each other and in proportions of a predefined ratio.

In one embodiment of the present invention, the first fluid is a compressible fluid and the second fluid is an incompressible fluid, the two fluids being nonmixable.

Alternatively, the two fluids, the first fluid and the second fluid, can be nonmixable gases.

In order to apply the above described method, which requires a variation of the pressure in the two distribution lines, an embodiment of an actuator according to the present invention includes means for the variation of the pressure inside the two distribution lines, these means being configured to maintain constant the difference in pressure for any values of the flow rate of the fluids moving in the distribution lines.

In the event of collision of the body driven by the actuator, the pressure of the fluid in one of the lines increases suddenly, causing a compression of the compressible fluid, which thresholds the actuation force applied to the driven link by the actuator and the inertial force applied to the driven link through the actuator by the preceding link.

The means for the variation of the pressures in the two distribution lines operate on the pressures of both fluids, thereby operating a variation in the compliance of the entire system and consequently a variation in the stiffness of the entire system.

A person skilled in the art will appreciate that there are several ways of realizing a control fluid as described above and they are all within the scope of the present invention.

In particular, a first way provides for the use of a biphasic fluid consisting of an incompressible fluid of liquid type or similar, and of a compressible fluid of gas type or similar.

Alternatively, the first fluid can be contained into a closed and sealed container includes into the two distribution lines. This closed and sealed container can be made of an elastically deformable material, which makes it possible to reduce the volume of the container due to a variation of pressure.

Another embodiment of the present invention has a fluidic circuit that includes at least two accumulators positioned respectively along the two distribution lines.

Each accumulator includes two rooms, namely, a first room and a second room, the first room being connected to the fluidic circuit and being filled with the second fluid, the second room being filled with the first fluid. At least the second room is made of an elastically deformable material so that the volume of the contained fluid can change.

A variant of this embodiment has the two rooms separated within the accumulator by a diaphragm made of an elastically deformable material.

As described above, at least one pressure sensor can be present and it can be used to measure the pressure into said two rooms Accordingly to another variant, the actuator can be realized as a double acting hydraulic cylinder.

The two distribution lines are therefore connected respectively to the two chambers of the hydraulic circuit, the chambers being separated by a piston providing for the delivery and return of the control fluid into the two chambers.

The piston operates as a member that transmits the motion of the actuator.

Since the distribution lines are connected directly to the chambers of the hydraulic cylinder, the above description related to the distribution lines applies also to the chambers in the event the actuator is realized as a double acting hydraulic cylinder.

Alternatively, the actuator can be realized as a rotational hydraulic actuator.

BRIEF DESCRIPTION OF THE DRAWINGS

Features and advantages of the present invention are clarified by the following description of a few embodiments and designs that are illustrated in the enclosed drawings, where.

For the sake of clarity of presentation, the figures refer to a design variant which is not intended to limit scope and breadth of the present invention.

In this design variant, the actuator connected to the hydraulic circuit consists of a double acting hydraulic cylinder with a linear translation of its piston.

It is however possible to use any other actuator known in the art, with no modification in the concepts expressed in the present description of embodiments of the invention.

In place of the hydraulic cylinder, a rotational hydraulic actuator may be employed, for example, which includes a rotating body connected to the distribution lines, the rotating body being moved by the motion of the control fluid in/out of the distribution lines.

DETAILED DESCRIPTION OF EMBODIMENTS OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 1:
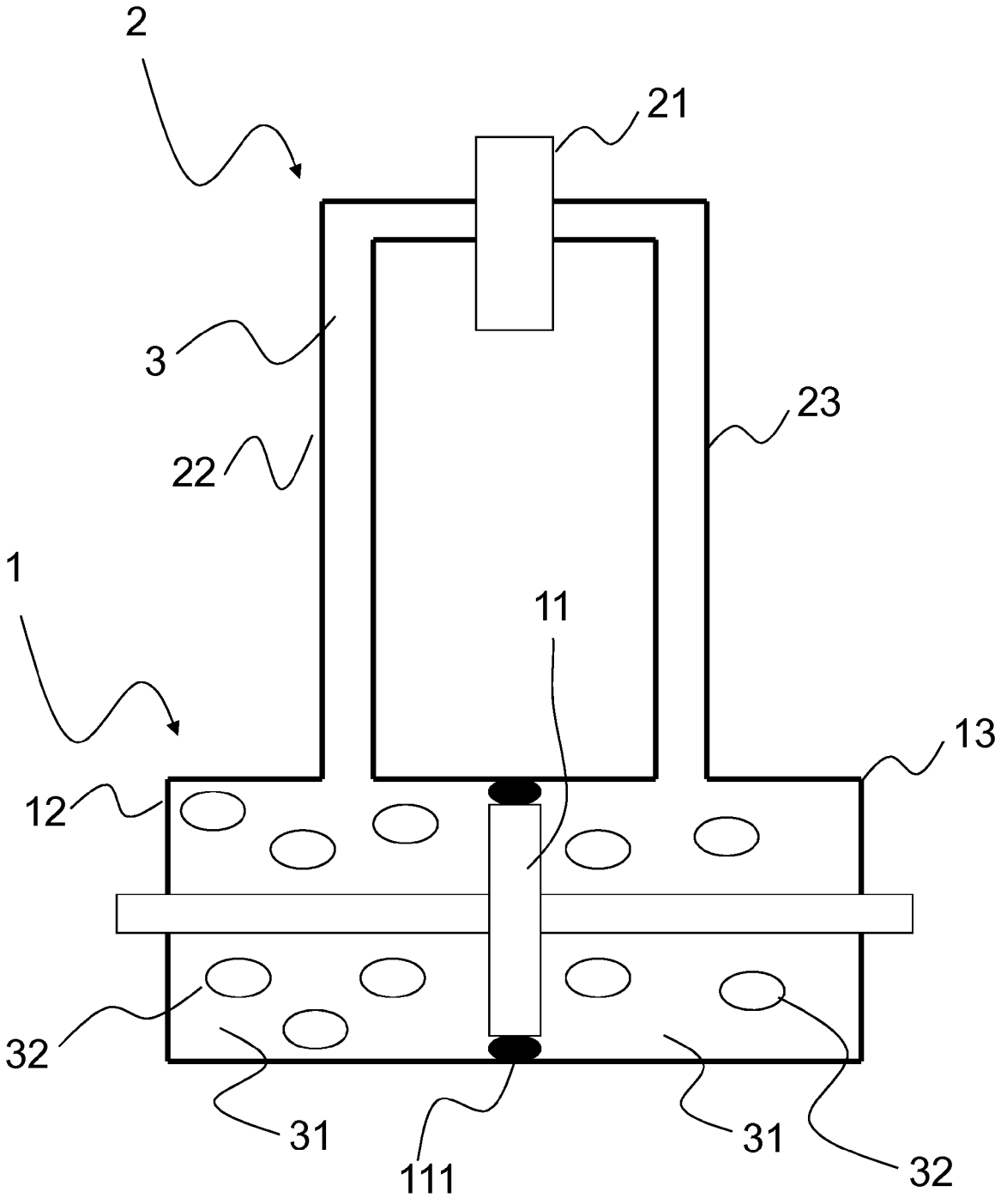
FIG. 1 illustrates schematically the operating principle of a variable stiffness actuator according to the present invention in one embodiment.

FIG. 1 shows a variable stiffness actuator according to the present invention, which is used for the application of the above described method.

The actuator consists of a double acting hydraulic cylinder 1 connected to a hydraulic circuit 2, inside which a control fluid 3 circulates.

The hydraulic circuit 2 includes a supply and distribution unit 21 of the control fluid 3, the supply and distribution unit having at least a reservoir of the control fluid 3 and pumping means.

The supply and distribution unit 21 has two distribution lines of the fluid, connected by hydraulic pipes 22 and 23 respectively to the two chambers 12 and 13 of hydraulic cylinder 1, chambers 12 and 13 being separated by a piston 11.

The distribution lines of the fluid are used alternatively to pump the control fluid 3 in/out of chambers 12 and 13 through hydraulic pipes 22 and 23.

The pumping means present in the supply and distribution unit 21 can move the control fluid in the hydraulic pipes 22 and 23 in both directions to add or remove fluid from the two chambers 12 and 13.

Control fluid 3 is made of two fluids, which include a first fluid 32 and a second fluid 31, nonmixable and in proportions according to a predefined ratio.

As previously described, the two fluids 31 and 32 can be both compressible.

In this case, the principle of operation does not change because means for the adaptation and control of the pressure of each fluid are considered, such means allowing a control of the stiffness of the system and of the motion of the actuator, as described above and as also extensively discussed below.

The quantities of fluids 31 and 32 can be selected and/or modified accordingly to the functional requirements for the production of actuator 1 based on a specific application or task.

Independently from the quantities of the two fluids 31 sand 32, the motion of piston 11 depends on the variations of pressures of fluids 31 and 32 inside chambers 12 and 13.

Seals of the O-ring type or similar 111 provide for translation without leakage of piston 11 inside cylinder 1.

Therefore, supply and distribution unit 21 may include means that vary the pressure inside the two chambers 12 and 13, with the aim of controlling the stiffness of the entire actuator.

The means that vary the pressure can be realized with any device known in the art, such as for example pumping means and systems of valves. The means that vary the pressure are configured to maintain the difference in pressure constant or otherwise maintain constant the difference in pressure between the pressures in the two chambers 12 and 13.

Therefore, the means that vary the pressure provide for the resulting force of the actuator 1 to remain constant, increasing or decreasing the stiffness of the system respectively by increasing or decreasing the absolute values of the pressures inside the two chambers 12 and 13.

One embodiment provides for the use of at least one sensor, preferably two sensors, one for each chamber, for controlling the pressures of fluids 31 and 32 inside chambers 12 and 13.

The sensors are used to monitor the pressures continuously in time. This information can be used to modify the operation of the system according to the variation in the stiffness of actuator 1.

As shown in the following figures, several different designs of actuator 1 are possible, which include different geometries and configurations of hydraulic circuit 2. In any case, the presence of an incompressible fluid 31 and of a compressible fluid 32 inside control fluid 3 guarantees that operation is always the same.

In the particular case of FIG. 1, control fluid 3 is a biphasic fluid, made of an incompressible phase of a liquid or similar, and of a compressible phase of a gas or similar.

Consider a displacement of the piston 11 compressing the fluid contained in chamber 13, in such a way that chamber 13 behaves as the suction chamber of actuator 1 while chamber 12 behaves as the discharge chamber of actuator 1. The system may follow one of three possible working modes, and each working mode can be chosen alternatively by varying pressure in combination with the sensors, as described above and summarized here:

(a) the volume of fluid 32 remains constant, the volume of control fluid 3 flowing respectively inside/outside of the suction and discharge chambers is the same, and piston 11 moves at constant velocity, while the stiffness of the system is constant;

(b) the volume of the compressible fluid 32 decreases, the volume of control fluid 3 entering in discharge chamber 12 is higher that the volume of the control fluid leaving suction chamber 13, and the stiffness of the system increases;

(c) the volume of compressible fluid 32 increases, the volume of control fluid 3 entering into discharge chamber 12 is lower than the volume leaving suction chamber 13, and the stiffness of the system decreases.

Once the stiffness of the piston 11 has increased or decreased to a desired value, the system can be driven back to condition (a).

Figure 2:
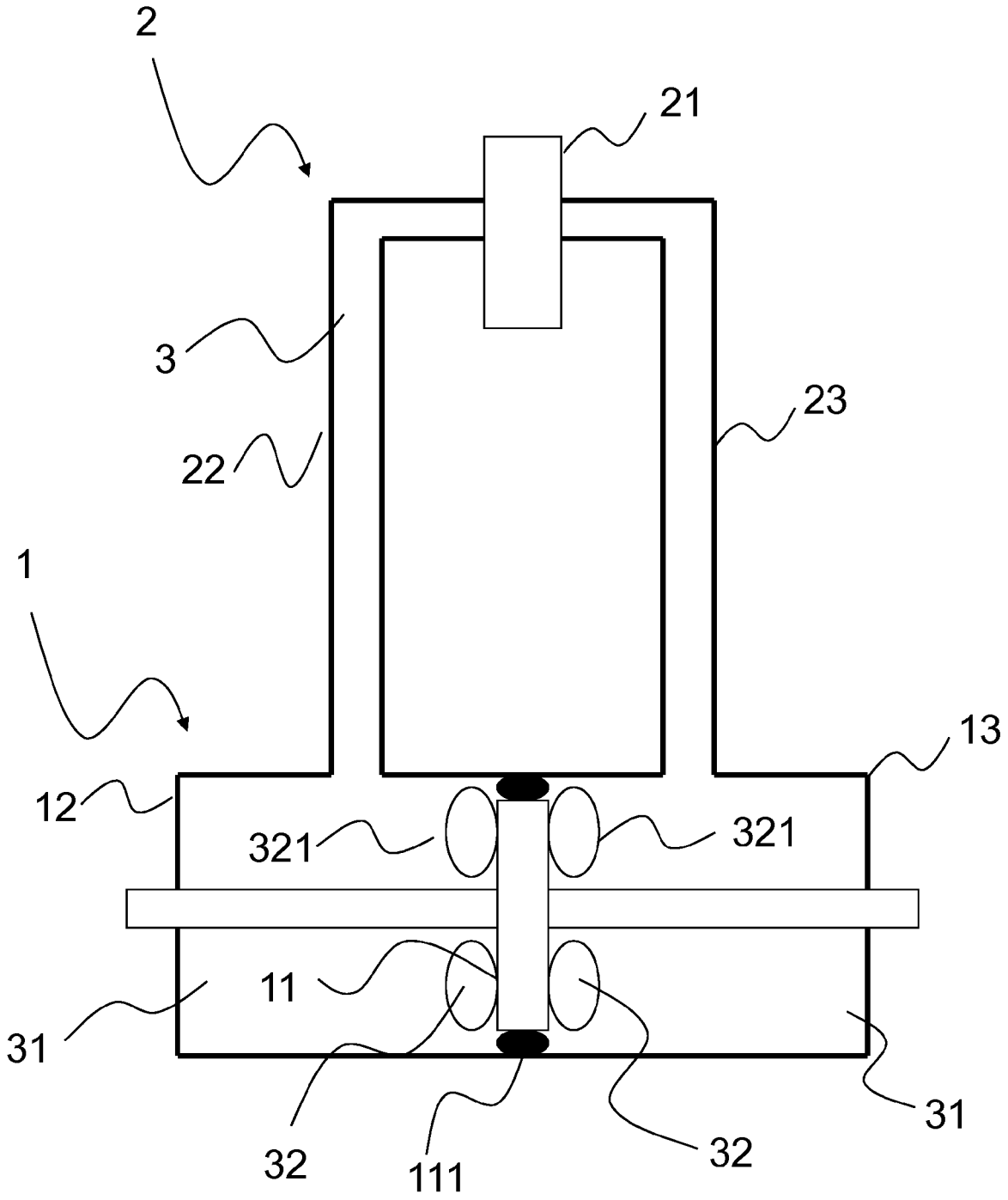
FIG. 2 illustrates schematically the operating principle of a variable stiffness actuator according to the present invention in another embodiment.

FIG. 2 shows a design variant of a variable stiffness actuator according to the present invention, where control fluid 3 consists of a gas 31 contained into a closed and sealed container 321 present inside the two chambers 12 and 13.

For the sake of clarity of presentation, FIG. 2 shows only one container 321 in each chamber, but any number of containers 321 may be present.

Closed and sealed container 321 is made of an elastically deformable material such that it is possible to modify the volume of the compressible fluid 31 that it contains. This modification of volume is achieved by means of an increase of pressure inside the two chambers 12 and 13, thereby obtaining the above described operation.

Figure 3:
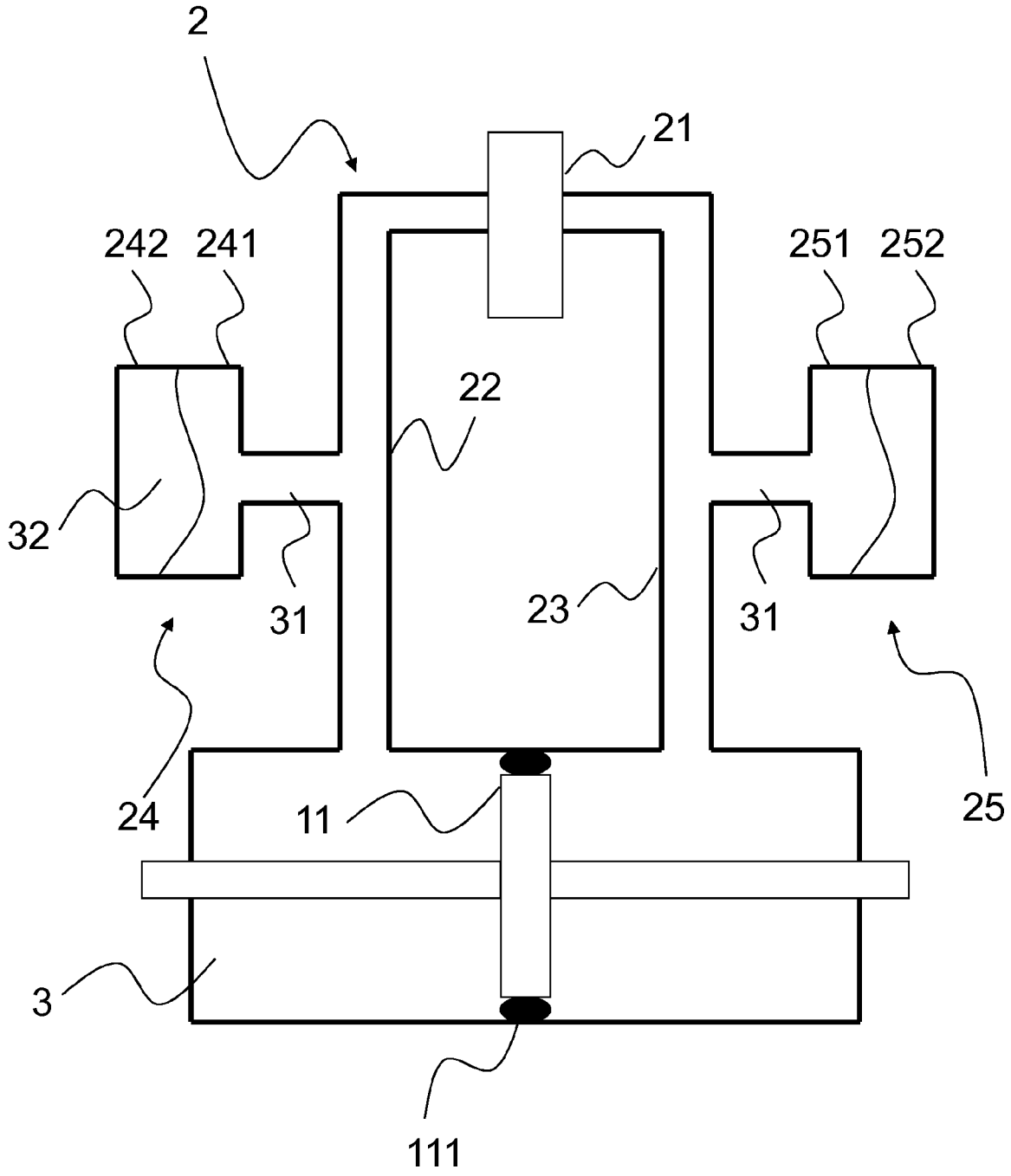
FIG. 3 illustrates schematically the operating principle of a variable stiffness actuator according to the present invention in a third embodiment.

FIG. 3 shows another design variant of an actuator 1 according to the present invention. In this variant, the hydraulic circuit includes two accumulators 24 and 25 positioned, respectively, before each of chambers 12 and 13 of hydraulic cylinder 1.

Each of accumulators 24 and 25 is connected respectively with one of distribution lines 22 and 23 of control fluid 3, and consists of a first room 241, 251, and a second room 242, 252.

Only first room 241, 251, of each accumulator is connected to one of the distribution lines 22 and 23 and contains incompressible fluid 31, while second room 242, 252, of each of accumulators 24 and 25 is filled with compressible fluid 32, which is then separated from the rest of hydraulic circuit 2.

This way, the fluid flowing inside hydraulic circuit 2 and into chambers 12 and 13 of hydraulic cylinder 1 is only incompressible fluid 31, while compressible fluid 32 is separated from hydraulic circuit 2 by means of a membrane.

In order to modify the volume of compressible fluid 32 inside room 242, 252, of each of the accumulators, part of the second room of the accumulators may consist of an elastically deformable material.

Preferably, the membranes should be made of an elastically deformable material, in such a way that compressible fluid 32 may reduce or increase its volume depending on the increment or reduction of the pressure of incompressible fluid 31, which, respectively, moves the membrane in the direction of second room 242, 252, or in the direction of first room 241, 251.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become apparent to those skilled in the art and the scope of the present invention is limited only by the appended claims.

The invention claimed is:

1. A method for adapting stiffness in a variable stiffness actuator comprising:

providing a variable stiffness actuator comprising:

a member configured to transmit motion; and a fluidic circuit connected to said member, a control fluid circulating within said fluidic circuit, wherein said fluidic circuit comprises a supply and distribution unit of said control fluid having a reservoir of said control fluid and a pumping unit, and wherein said supply and distribution unit comprises two distribution lines of said control fluid, said distribution lines being connected with hydraulic pipes to said member such that an increase or decrease in pressure of said control fluid activates said member to transmit said motion;

providing said control fluid comprising a first fluid and a second fluid separate from each other and in proportions according to a predefined ratio; and adapting a stiffness of said actuator by adapting said pressure of said control fluid into said two distribution lines.

2. The method according to the claim 1, wherein the step of providing said control fluid comprises providing said first fluid as a compressible fluid and said second fluid as an incompressible fluid, and wherein the step of adapting a stiffness of said actuator comprises adapting pressures of said first and second fluids, said first and second fluids being nonmixable.

3. The method according to the claim 1, wherein the step of providing said control fluid comprises providing said first fluid and said second fluid as gases, and wherein the step of adapting a stiffness of said actuator comprises adapting pressures of said first and second gases.

4. The method according to claim 1, further comprising the step of changing pressure of delivery and pressure of return in said two distribution lines in order to keep constant a difference between said pressure of delivery and said pressure of return.

5. The method according to claim 4, further comprising the step of controlling pressures in said two distribution lines with at least one pressure sensor.

6. The method according to claim 4, wherein the step of adapting said pressure of said control fluid is performed in real time.

7. A variable stiffness actuator comprising:

a member configured to transmit motion; and, a fluidic circuit connected to said member, a control fluid circulating within said fluidic circuit, wherein said fluidic circuit comprises a supply and distribution unit of said control fluid having a reservoir of said control fluid and a pumping unit, wherein said supply and distribution unit comprises two distribution lines of said control fluid, said distribution lines being connected with hydraulic pipes to said member such that an increase or decrease in pressure of said control fluid activates said member to transmit said motion, and wherein said control fluid comprises a first fluid and a second fluid separate from each other and in proportions according to a predefined ratio.

8. The variable stiffness actuator according to claim 7, wherein such first fluid is a compressible fluid and said second fluid is an incompressible fluid (31), said first and second fluids being nonmixable.

9. The variable stiffness actuator according to claim 7, wherein said first fluid and said second fluid are nonmixable gases.

10. The variable stiffness actuator according to claim 7, further comprising a system configured to vary an absolute value of pressure into said two distribution lines, said two distribution lines comprising a distribution line of delivery in a distribution line of return, a difference in pressure between a pressure of said control fluid in said distribution line of delivery and in said distribution line of return being constant.

11. The variable stiffness actuator according to claim 7, wherein said control fluid is a biphasic fluid comprising an incompressible phase of liquid type liquid and a compressible phase gaseous type.

12. The variable stiffness actuator according to claim 7, wherein said first fluid is contained into a closed and sealed container comprised into said two distribution lines, said closed and sealed container being made from an elastically deformable material.

13. The variable stiffness actuator according to claim 7, wherein said fluidic circuit comprises at least two accumulators positioned respectively along said two distribution lines, each of said accumulators comprising a first room and a second room, said first room being connected to said fluidic circuit and being filled with said second fluid, said second room being filled with said first fluid, at least said second room being made of an elastically deformable material.

14. The variable stiffness actuator according to claim 13, wherein said two rooms are separated with a diaphragm made of an elastically deformable material.

15. The variable stiffness actuator according to claim 13, further comprising at least one pressure sensor, said pressure sensor being configured to measure pressure into said two rooms.

16. The variable stiffness actuator according to claim 7, wherein said actuator comprises a double acting hydraulic cylinder, wherein said two distribution lines are connected respectively to two chambers of said hydraulic circuit within said hydraulic circuit, said chambers being separated by a piston that delivers and returns said control fluid into said two chambers, and wherein said piston is said member configured to transmit motion.

17. The variable stiffness actuator according to claim 7, wherein said actuator is a rotational hydraulic actuator.

* * * * *